United States Patent [19]

Medellin et al.

[11] Patent Number: 4,895,418

[45] Date of Patent: Jan. 23, 1990

[54] REFRESHMENT CENTER FOR USE WITH BOTTTLED WATER DISPENSERS

[75] Inventors: David G. Medellin; Robert A. Pope, both of San Jose, Calif.

[73] Assignee: David G. Medellin, Honolulu, Hi.

[21] Appl. No.: 251,117

[22] Filed: Sep. 29, 1988

[51] Int. Cl.[4] ..... A47B 49/00

[52] U.S. Cl. ..... 312/252; 211/86; 211/110; 108/38; 312/297

[58] Field of Search ..... 211/86, 110, 131; 312/249, 251, 252, 254, 266, 107, 281, 297, 305; 108/25, 38, 41, 45

[56] References Cited

U.S. PATENT DOCUMENTS

| | | | |
|---|---|---|---|
| D. 72,301 | 3/1927 | Wanerman | D7/305 |
| D. 254,109 | 2/1980 | Price | D7/305 X |
| D. 266,056 | 9/1982 | Lear | D7/306 X |
| 268,800 | 12/1882 | Johnston | 312/254 X |
| 524,056 | 8/1894 | Cummings | 312/249 |
| 2,232,031 | 2/1941 | Kavanagh | 312/251 |
| 2,657,554 | 11/1953 | Hull | D7/311 X |
| 3,729,242 | 4/1973 | Barnay | 312/107 |
| 3,850,114 | 11/1974 | Ganteaume | 108/38 |
| 4,385,212 | 5/1983 | Tyler | 312/111 X |
| 4,495,404 | 1/1985 | Carmichael | D7/305 X |
| 4,515,421 | 5/1985 | Steffes | 312/214 X |
| 4,525,882 | 7/1985 | Stenberg | 211/184 |
| 4,552,272 | 11/1985 | Field | 211/184 |
| 4,664,349 | 5/1987 | Johansen et al. | D7/306 X |

*Primary Examiner*—Joseph Falk
*Attorney, Agent, or Firm*—Jacques M. Dulin

[57] ABSTRACT

A portable refreshment center particularly adapted to fit over a conventional water bottle of a water bottle dispenser comprising a compartmentalized refreshment item retaining means for orderly storage of various individual condiment and refreshment items, and a mounting means for mounting it on the water bottle. In a first embodiment, the compartmentalized retaining means includes adjustable compartments provided for by individually movable vertical and horizontal dividers, a hinged and latchable closure means for securing contents against spillage during transport, a work surface for cutting and serving refreshment items, and optional storage areas for serving trays, utensils and napkins. A cantilevered bi-positional L-shaped tote tray is releasably engagable with a U-shaped slotted support bracket and is adapted to carry cups or other items. A second embodiment comprises a cylindrical carousel adapted to rotate on a plate or cap engaging the inverted bottom of the water bottle. The carousel-type compartmentalized retaining means comprises a tiered array of storage compartments formed by the intersection of annular rings having lipped outer edges for prevention of spillage of stored items and spaced vertical dividers secured to the inner cylinder wall. Individual or tambour doors are optionally provided as compartment closure means. In both embodiments, a water level view slot and an air passage may be provided.

43 Claims, 2 Drawing Sheets

REFRESHMENT CENTER FOR USE WITH BOTTTLED WATER DISPENSERS

FIELD

This invention relates to refreshment centers adapted to be receivingly supported atop an inverted water bottle of typical bottled water dispensers.

DEFINITIONS

In this application, the term "water dispenser" means a stand with provision for a reservoir of bottled water within its interior and a bottle inverted atop the stand to provide for replenishing the reservoir. A water dispensing valve and drip tray are also included.

The term "bottle or water bottle" means a hollow vessel of glass, plastic or the like, having a narrow mouth and usually no handles for carrying bottled water to a use site, and being used at such site as a reservoir or source of water. In a preferred form, the sides are cylindrical and the top wall is swaged to form a more narrow mouth. The bottom wall is circular in cross section and generally planar.

"Refreshment Center" means a compartmentalized storage unit for the orderly storage of individual refreshment items, particularly adapted for use in combination with a water dispenser. In the preferred form, the refreshment center has features including: a work surface for cutting and serving refreshment food items; optional storage areas for serving trays, napkins, and utensils; a bi-positional cup retaining tray; and securing and latching means for portability without spillage of contents.

BACKGROUND

Many business offices, small factories and shops offer their employees nothing more than a water cooler, and a hot plate or coffee maker. The storage of the various "makings" for coffee, tea, soup, cocoa, etc., are at best hap hazard, and may amount to nothing more than a converted cabinet or top of a mini refrigerator. As spoons are left lying loose or are placed in unused coffee cups, non dairy creamer is offered in the original jars, or the packets are offered in the boxes in which they are sold.

In many locations, there is insufficient room for other items such as coffee cakes, donuts, sandwiches and the like.

By the same token, bottled water dispensers are fairly conventional and offer nothing more than the water in bottles, which may be offered at room temperature, or may be chilled or heated with special dispenser units. But there is no provision for associating the water with a container dispenser unit for all the ingredients for coffee, tea, cocoa, soups, etc., and for serving coffee cakes, cakes, pies and other food.

There are many references disclosing the invention of and improvements to liquid refreshment dispensers.

U.S. Pat. No. 2,657,554 discloses a device for providing temperature control means for a liquid dispenser. It also teaches the use of an agitation means to maintain the solids or semi solids of a beverage, such as a fruit juice, in uniform suspension.

U.S. Design Pat. No. D 72,301; D 254,109; D 266,056; and D 83,999 show various ornamental design alternatives for liquid refreshment dispensers, wherein a rotatable cup holder, a disposable cup holder, a bottle cover for water cooler bottles, and a tall, slim cabinet having a faucet and drip pan are provided, respectively as design improvements to liquid refreshment dispensers.

U.S. Pat. No. 4,664,349 discloses a collapsible stand for a water dispenser having capability for easy disassembly and storage in addition to use as a conventional non-collapsible stand for water dispensers.

As can be seen, the above references do not provide for a relatively compact, simple refreshment center adapted to be associated with the water bottle of a standard water type cooler so that the water is available for use with the various coffee brake ingredients.

Accordingly, there is a need in the art for a special refreshment storage and dispensing center which is specially adapted for use with fresh pure water dispensers such as bottled water dispensers.

SUMMARY

The present invention comprises a portable refreshment center adapted to be cooperatively supported by the water bottle of a standard water cooler. In a first principal embodiment a compartmentalized shallow box, preferably having a lid, is provided in association with a cylindrical hub means either central thereof or secured to a bottom panel of the box. The cylindrical hub means is adapted and oriented to snugly fit over the upper portion of the inverted end of a water bottle of a conventional bottled water dispenser. The hub means is sized for snug fit on the water bottle for wobble-free support, yet loose enough to permit easy removal. The compartments are laid out so the removed refreshment center can stand by itself when placed on a table or floor while the water bottle is being changed, without tipping over even when loaded with various items such as sugar, cream, tea packets, plastic spoons, forks, napkins, etc.

In the first principal embodiment, the box is rectangular and its bottom is attached to the hub means. A planar bottom panel of rectangular cross section is attached at its terminal edges to pairs of spaced-apart side panels, defining the box therebetween. Additional vertical panels criss-cross between the side panels to form a series of compartments within the box. These compartments are sized and adapted to provide the space required for storing the various different items associated with a well-stocked refreshment center. A hinged lid atop the compartmentalized tray adds portability features. In the closed (and optionally locked) position, the lid serves two principal functions: (1) it prevents the contents of the compartments from spilling during transport of the fully stocked refreshment center compartmentalized tray from a central location to a use site; and (2) its top surface serves as a work surface for cutting and serving, e.g. for placing and cutting portions of coffee cake thereon, donuts, etc. Yet, in the operating position at 90° to the compartments, the lid permits easy access of the refreshment packets and associated accessories.

In a second principal embodiment of the invention, the box means compartment is arrayed in a carousel which fits over and is rotatable about a hub means rotatably resting on or fitting over the bottom segment (upper end in use) of the inverted water bottle of the dispenser. In order to provide more compartments, the crown or top plate of the carousel attaches to a transverse cylindrical side wall extending at 90° to the crown at least partially coextensive with and parallel to the circumferential surface of the water bottle. Annular rings with vertical separators are vertically spaced in contact with the side wall to provide vertically arrayed tiers of compartments. These compartments are used in stowing the refreshment packets and associated serving accessories. Additionally, cover panel means for the compartments as well as a storable handle within the carousel are provided. The cover panel may be permanent or removable, and may be a pivotable or slidable single panel or a tambour-type panel assembly.

In both embodiments, the hub means may be either permanently attached to the bottom panel of the compartmentalized tray, or removably and rotatably attached to the carousel via a bearing assembly to permit rotation of the carousel about the hub means.

Additionally, the compartments that are formed within either the compartmentalized tray or the carousel provide the spaces required for storing the different items associated with a well-stocked refreshment center. The compartments can be divided to provide separate spaces for the following items: instant coffee, tea, roast coffee, sugar and milk substitutes in packet form, paper napkins, condiments, eating utensils, trays or mini-trays, pre-moistened towelettes, etc. Special provision may be made for holder labels so that the compartments may be individually labeled by the user in whatever arrangement best suits the user's needs.

Both embodiments may include one or more areas for storing service trays. There can also be provided, on opposite side panels of the compartmentalized tray, respectively, of the first embodiment, a rectangular cantilevered utensil or napkin storage bin, and means for supporting an elongated, L-shaped tote tray. The cantilevered storage bin provides storage space for utensils and napkins when the top of the lid is being used as a counter top for a coffee cake or other like food items so that it can be portioned without need for access to the compartments inside. The tote tray support means permits storage and use of L-shaped tote tray which is preferably provided with an array of holes for receiving cups therein in either one of two positions. In a first position the tote tray is supported by a U-shaped support member so that the shorter leg of the tray is horizontal. In the second position, the longer leg of the tray is horizontal. Thus, either a single row of cup openings are provided (first position) or a matrix of such cup openings, say 3 x 3, is provided (second position).

DRAWINGS

FIG. 1 is a front three-quarter perspective view of the first embodiment of the invention showing the hinged lid of the refreshment center being partially opened to reveal a compartmentalized tray for storing refreshments and accessories the compartmentalized tray also being shown in association with an integral of removable fixed or rotatable cylindrical hub means that slips over the water bottle of a conventional water dispenser shown in phantom lines to support and stabilize the refreshment water;

DETAILED DESCRIPTION OF THE BEST MODE OF THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
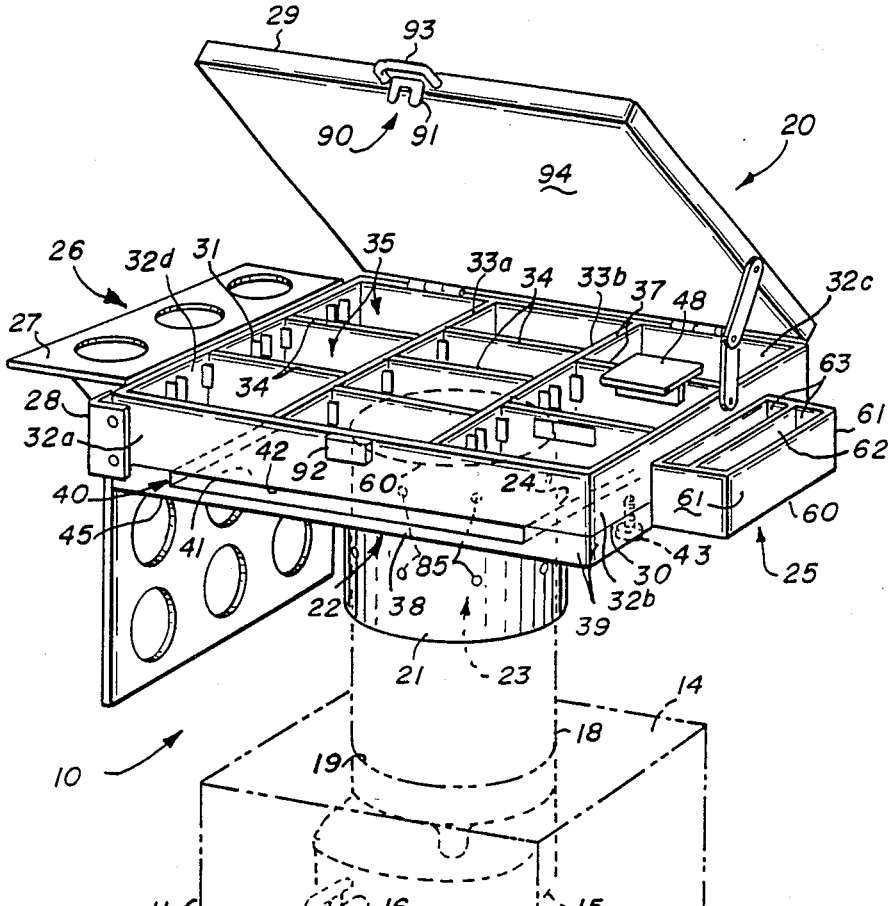

FIG. 1 is a perspective view of a first embodiment of the refreshment center 10 of the present invention in association with a conventional water dispenser 11 (shown in phantom lines). The water dispenser 11 includes a series of side panels 13, and a top panel 14 configured to provide access to a water reservoir 15 at the interior. A dispensing spigot 16 and drip tray 17 are also included, the spigot 16 being operated to permit flow of the bottled water from the reservoir 15 to fill cups and the like (not shown) positioned below the valve 16. At the top panel 14, the inverted bottle of water 18 extends through an opening 19 in the top panel so that its contents can be gradually emptied into the reservoir 15. The water bottle 18 may be of glass or plastic material. The conventional 5 gallon bottles are of standard size, typically 10–11 inches in outer diameter and 14–15 inches from bottom to shoulder. This leaves a vertical exposed height of from 15 to 16 inches above the top surface 14.

In accordance with the present invention, the portable refreshment center 10 comprises a compartmentalized tray 20 in operative association with a hub means 21 adapted to receivingly engage the water bottle 18. The hub means 21 generally comprises a cylindrical tube to provide a bottle cavity, generally indicated at 23, best seen in FIGS. 4 and 5. The cavity 23 is configured and oriented so as to snugly fit over the upper end segment 24 of the inverted water bottle 18, i.e. the bottom of the water bottle. Note that the tray 20 may be connected to the hub means 21 by an optional base means 22. To mount the refreshment center, the tray bottom may be grasped and lifted high enough so the cylindrical hub slips down over the water bottle. Enough side clearance is provided to permit the tray 20 to be rotated to a convenient orientation.

In one form of the invention, the compartmentalized tray 20 includes a generally planar bottom panel 30 (FIG. 1 and 2) attached at its terminal edges to upstanding, spaced side panel 32. The bottom panel 30 in this embodiment is preferably rectangular in cross-section, but may be any convenient shape such as square, round, polygonal or irregular. The optional base means 22 may be attached to the exterior bottom undersurface 33 of panel 30 in co-planar fashion. The side panels 32 comprise, in the embodiment illustrated, four separate panels **32*a*, 32*b*, 32*c* and 32*d*, attached together at respective ends in an upright vertical orientation parallel to the center axis of hub means 21**.

Additional vertical panels, generally indicated at 33 and 34, criss-cross between the side panels 32 *a–d* to form a series of compartments 35. These compartments 35 provide the space required for storing the different items associated with a well-stocked refreshment center 10. The compartments 35 can be divided so as to provide separate spaces for the following items: instant coffee, tea, roast coffee, sugar and milk substitutes in packet form, condiments, napkins, utensils, hot or cold drink mixes, etc. Depending upon the size and shape of the compartments 35, accessories can also be stored within the compartmentalized tray 20, such accessories including spoons, forks, small paper napkins and the like. As seen in FIG. 1, note that the compartments 35 can be designated in row and column notation wherein first and third compartments columns generated designated $C_1$ and $C_3$ are similar and define compartment $R_1$, $R_2$ and $R_3$. The second column is designated $C_2$ and includes four compartments $R'_1$, $R'_2$, $R'_3$ and $R'_4$. The panels 34 maybe laterally adjustable in predetermined increments by pairs of tabs 31 provided on panels 32*d* and 33*a*, so that compartments $R_1$, $R_2$ and $R_3$ may be sized by the user as desired.

The optional base means 22 is preferably a shallow box having a base plate 38 form a deep recess 41. The deep recess 41 is accessible to service trays (not shown) for storage purposes via entry slot 42. Attachment is by means of self-taping screws 43 through the baseplate 38 into the bottom panel 30 of the compartmentalized tray 20. After assembly with the compartmentalized tray 20, the recess 41 has sufficient vertical dimension to accommodate a series of stacked conventional service trays (not shown). The dimensions of notch 40 may be selected to match any desired size of trays.

Exterior undersurface 45 of the base means baseplate 38 in this embodiment is rectangular in plan view. It is also disposed parallel to the undersurface 36 of the bottom panel of the compartmentalized tray 20.

Attachment of the base means 22 or the tray 20 to the hub means 21 can be achieved in a variety of ways. In one embodiment, these components may be integrally molded or otherwise manufactured as a single unit. Or the hub means 21 can be attached to the undersurface 45 of base plate 38, or undersurface 36 of bottom panel 30 using an adhesive or other securing means. Still further, the cylindrical wall 21 of the hub means can be flared at the top to form a horizontal flange and screws or other fasteners (not shown) used to attach the flange to bottom panel 30 or baseplate 38. The refreshment center 10 of the present invention may also include optional auxiliary components that are preferably individually manufactured and then mechanically or adhesively attached as required. These optional auxiliary components include: storage bin 25 on side panel 32*b* of tray 20; tote tray support assembly 26 including cup tote tray 27 and U-shaped support 28 on the side panel 32*d* of the tray 20; and hinged lid 29.

OPTIONAL STORAGE BIN

The storage bin 25 includes a bottom panel 60 and a series of 3 side panels 61. Optionally, one or more inner separator(s) 62 may be used to form two or more compartments 63. Each compartment 62 is seen to be rectangular in cross section. Attachment of the bin 25 is to side panel 32*b* of the compartmentalized tray 20. Preferably, a series of self-tapping screws (not shown) may be used.

In operation, the cantilevered storage bin 25 provides storage space for utensils and napkins when the lid 29 is closed so the top thereof can be used as a serving counter for coffee cakes, pies, donuts, birthday or other occasion cakes, etc. When used in that way, it is inconvenient to open the lid for access, so the exterior bin is provided. Alternately, the lid may cover only a part of the tray 20, providing access at all times to at least some of the compartments $R_1$, $R_2$, etc.

TOTE TRAY AND SUPPORT ASSEMBLY

On the side panel 32*d* (left side in FIG. 1, right in FIG. 2), there is provided a tote tray and support assembly 26. Its purpose is to permit an L-shaped tote tray 27 to be stored or supported for a variety of uses. The tray 27 can be used as such independently from the refreshment center 10. However, it is specially adapted to be used with the U-shaped slotted support bracket 28 (hereafter referred to as support bracket) in either one of two positions (see FIG. 2). In a first orientation, the tote tray 27 is slipped into space S between the side panel 32*d* and the support bracket 28 so that shorter leg 72 is perpendicular to the side panel 32*d*, i.e., leg 72 is horizontal (as shown in FIG. 1). The tray in this position is designated "I". In the second orientation, the long leg 73 is perpendicular to the same side panel 32*d*, i.e. leg 73 is horizontal, and is designated "II". In either position, note that triangular braces 75 (between the legs 72, 73) are oriented to slide into engagement with suitably-sized slots 76 in support bracket 28. In that way, either a single row of openings generally indicated at 77 are provided (such openings 77 associated with short leg 72 having identical diameters sized to support a series of refreshment cups in a vertical orientation without spillage), or a matrix of such openings generally indicated at 78 associated with long leg 73, say a 3 x 3 matrix, is provided. The holes may be of the same or different size.

Support bracket 28 is U-shaped in cross-section, includes two end arms 80 that extend parallel to side panels 32*a* and 32*c* of the compartmentalized tray 20 and is disposed to define space S. The support bracket 28 is conveniently attached to the side panels 32*a* and 32*c* by way of screws 81. The width of space S is just slightly greater than the thickness of the leg panels 72 and 73 so that they become releasably wedged between facing inner surfaces 86 and 87 of the side panel 32*d* and the support bracket 28, respectively. As a result, the tote tray 27 is supported in a cantilevered manner without undue tipping such as would result in spilled drinks.

HINGED LID

Optionally a hinged lid 29 may be provided atop the compartmentalized tray 20 and is preferably opened to a vertical position. Latch assembly 90 (FIG. 1) of conventional design employing tag 91 that connects internally of catch 92. After the lid 29 is locked using latch assembly 90, the refreshment center can be easily carried from place-to-place using carrying handle 93. Additionally, since interior surface 94 of the lid 29 is disposed to be in close proximity to the free edges 37 of each compartment 35 of the tray 20 (in the closed locked position), refreshment contents do not spill or intermix during transport from a central location to the use site.

When the refreshment center is being transported from location-to-location, note that the tote tray 27 can be stored in two locations, viz., within space S between the U-shaped support 28 and the side panel 32*d*, or within the recess 41 of the base 22. If the former is used, the preferred position is with the longer leg 73 being inserted in the gap S.

Swinging the lid 29 from position to position is provided by hinges 95 (FIG. 2) attached between the side panel 32*c* of the compartmentalized tray 20 and marginal edge 96 of the lid 29. The direction of lid movement is in the direction of arrows 97, and rotation is about axis A—A. In the full open position, the lid 29 is at 90° relative to the compartmentalized tray 20. It can be held in position by means of locking arm assembly 96 (FIG. 1).

ALTERNATE CAROUSEL EMBODIMENT

Figure 2:
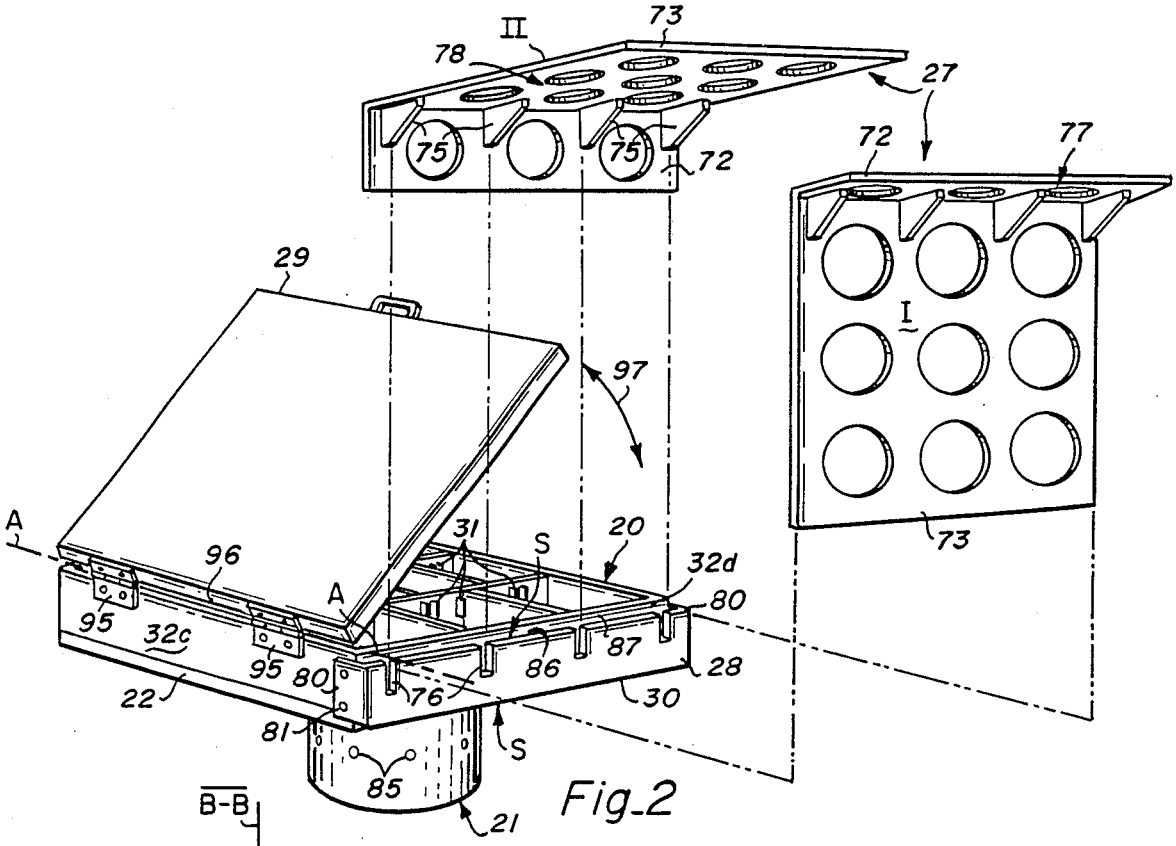
FIG. 2 is a rear three quarter perspective view of the refreshment center of FIG. 1 and shows the optional detachable bi-positional L-shaped tote tray and tray support means attached at one side of the refreshment center to hold a series of coffee or refreshment cups in two alteration upright, stable positions.
Figure 3:
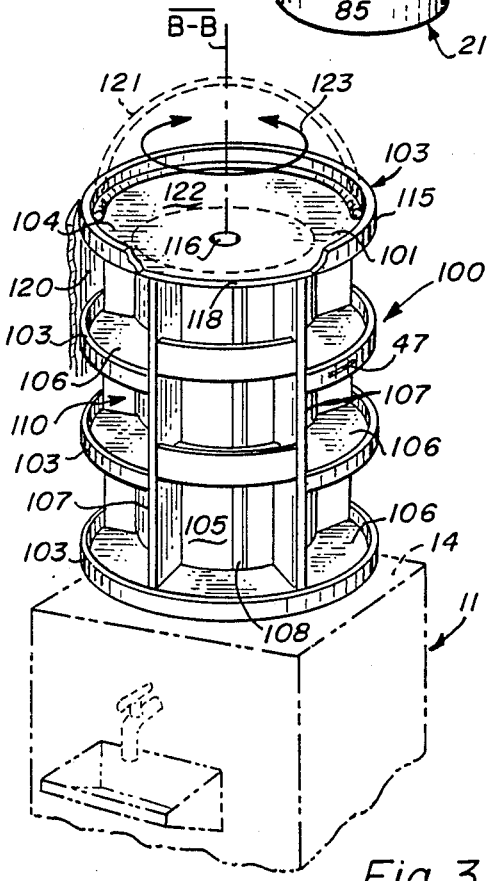
FIG. 3 is a front three quarter perspective view of a second embodiment of the refreshment center of the invention in association with a conventional water dispenser, such center illustrating a tiered, rotatable or fixed carousel assembly mounted on a cylindrical hub means that receiving engages the water bottle.

In another form of the invention shown in FIGS. 3–6, the compartmentalized tray 20 of FIGS. 1 and 2 is adapted restructured wrapped around the side wall of the bottle 18 in the form of a carousel generally indicated at 100 in FIG. 3. The carousel 100 fits over and is rotatable about substantially stationary hub means 101 (FIGS. 4 and 5) which may be in the form of a flat plate (FIG. 4) or a cap 102 that fits over the upper end 24 of the inverted water bottle 18 of the dispenser. In order to provide a suitable number of compartments for the carousel 100, top plate 104 of the carousel 100 has a diameter greater than that of both the hub means 101 and the water bottle 18. The top plate 104 is attached to cylindrical inner wall 105 of a height Ho. The side wall 105 is spaced outwardly from the circumferential outer surface of the water bottle 18, and is slightly shorter than the exposed portion of inverted bottle 18 extending above the top panel 14 of the dispenser 11 (see FIG. 3). Because of the relative lengths vis-a-vis the side wall 105 and the bottle 18 above the dispenser 11, rotation of the carousel 100 about axis B—B in the direction of arrows 123 is permitted. Moreover, the carousel 100 and the water bottle 18 are coaxially aligned.

Annular rings 106 are vertically spaced along and in contact with the side wall 105 to provide tiers of compartments generally indicated at 110 for stowing the refreshment packets and associated items including serving accessories. Vertically, radially-extending separate panels comprise the side walls of the compartments. Upstanding flanges 103 on the outer margin of the annular rings 106 prevent the stored contents from spilling out. While shown as only 10–20% of the vertical distance between adjacent rings, they may extend upwardly 50% or more.

A longitudinal slot 108 (FIG. 5) extends nearly the full length of the side wall 105 to permit viewing the water level within the bottle 18. Alternately, main wall 105 may be transparent in whole or in part. Likewise, holes 85 can be provided to permit air to escape when mounting the refreshment center, and to prevent a resisting force resulting from a vacuum build up when dismounting the refreshment center.

Figure 5:
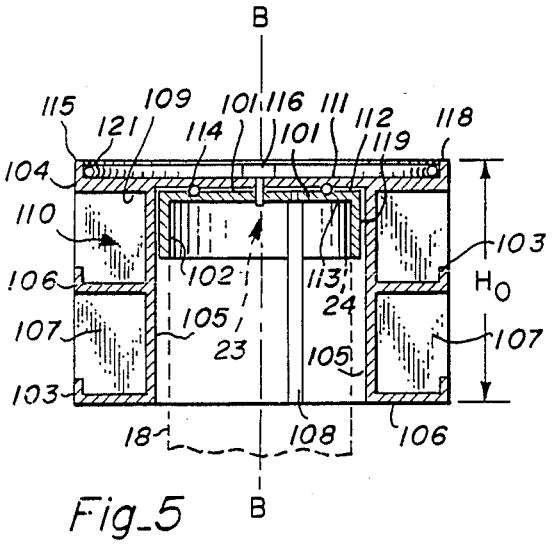
FIG. 5 is a section view of the carousel embodiment taken along line 5—5 of FIG. 4.

As best seen in FIG. 5, the hub means 101 is also preferably configured as a cap 102. The diameter of the hub means 101 is selected to be slightly larger than that of the water bottle 18. In that way, side wall 119 of the cap 102 fits snugly about the circumferential outer surface of the bottle 18. Further, the hub 101 includes top surface 112 having a circular groove 113 of semi-circular cross section, into which a series of ball bearings 114 of a bearing assembly are disposed. A portion of each ball bearing 114 extends above the top of the groove 113 and contacts corresponding groove 111 in the underside 109 of the carousel top plate 104. A central pin 116 extends through appropriate openings to rotatably connect the top plate 104 to hub 101, permitting the carousel 100 to easily rotate relative to the hub 101 (or cap 102).

Optionally, removable cover means fragmentally viewed at 120 in FIG. 3 may be initially placed over the compartments 110 at the replenished center prior to transport to the use site. Such removable cover means 120 in association with storable wire handle 121, achieves portability without spillage. The removable cover means 120 is preferably a commercial plastic wrap or a metal foil which may be removably adhered to the outer faces of the edge flanges 103.

Note that the upper lip 115 has a relieved portion 118 which permits easier access to the top surface 122 of top plate 104 for cutting of food portions and for cleaning. Note also that the carousel may be elevated; that is, as best seen in FIG. 3, the top plate 104 may be spaced some distance above the hub 101*a*, resting on the top of the water bottle, to provide more tiers of shelves 106. Labels 47 (FIGS. 1 and 3, or label holders 48 may also be provided.

Figure 6:
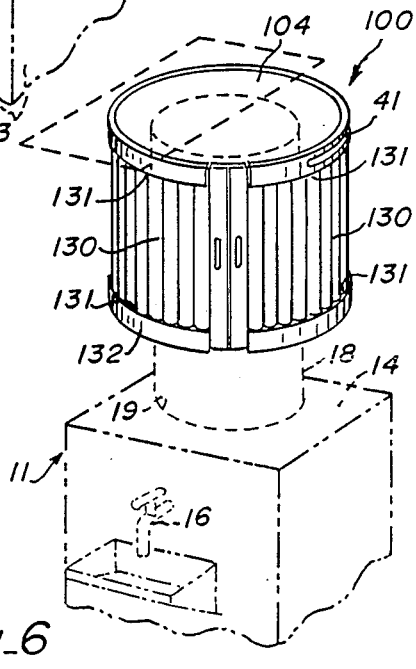
FIG. 6 is a front three quarter perspective of the carousel embodiment showing tambour doors closed and showing provision of tray storage recesses.
Figure 4:
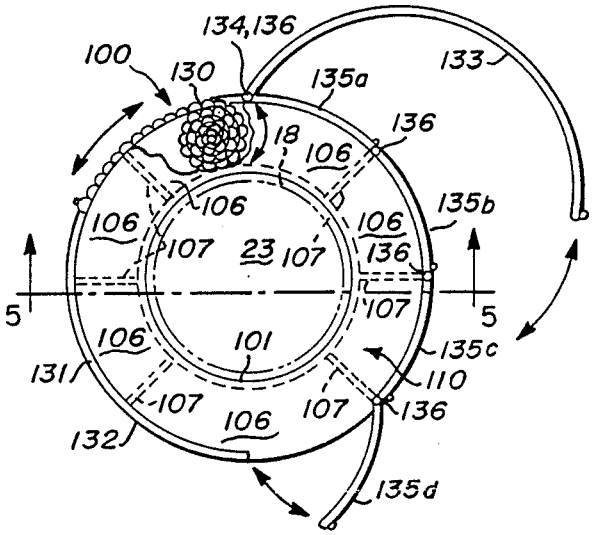
FIG. 4 is a bottom plan view of the underside of the carousel embodiment and showing on the left side a tambour door arrangement, and on the right side use of single or multiple door closures.
Figure 1:
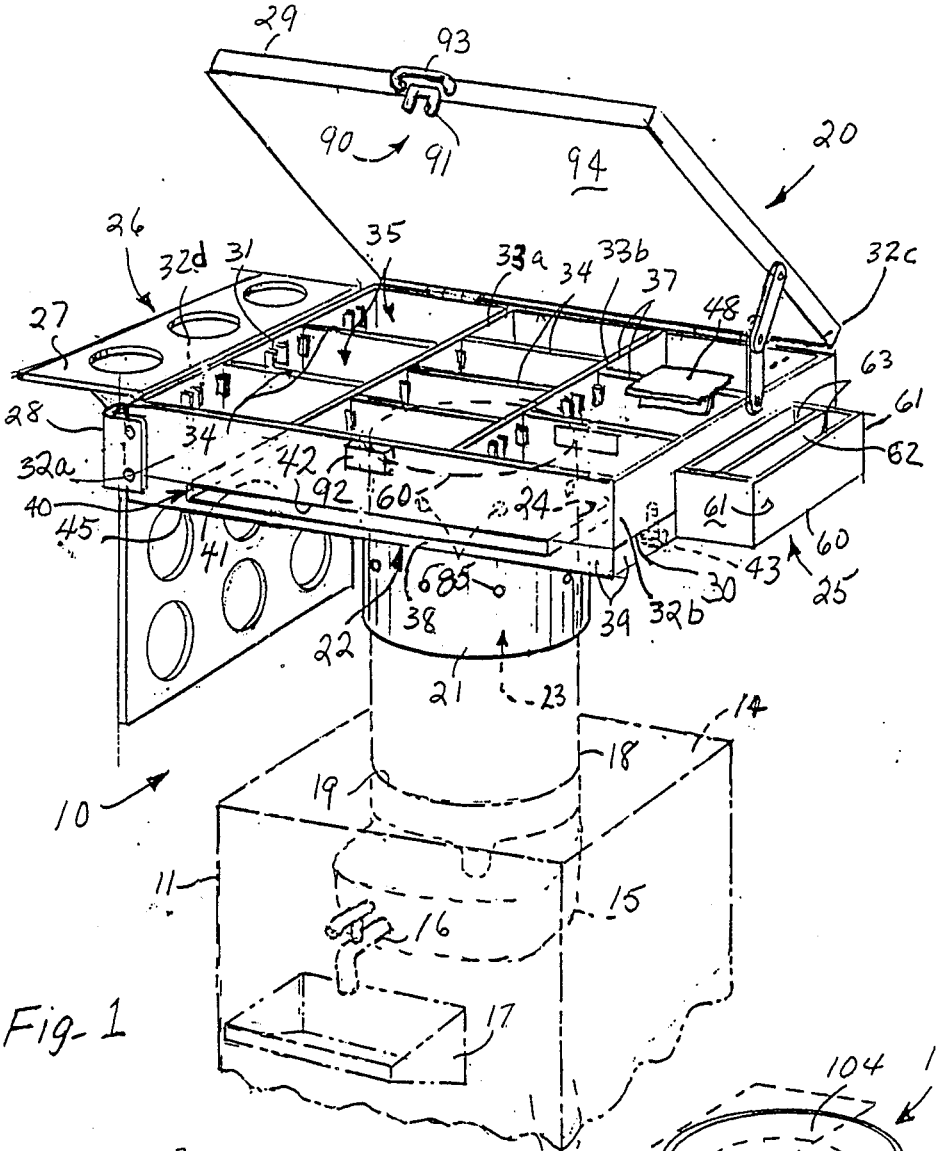
Figure 5:
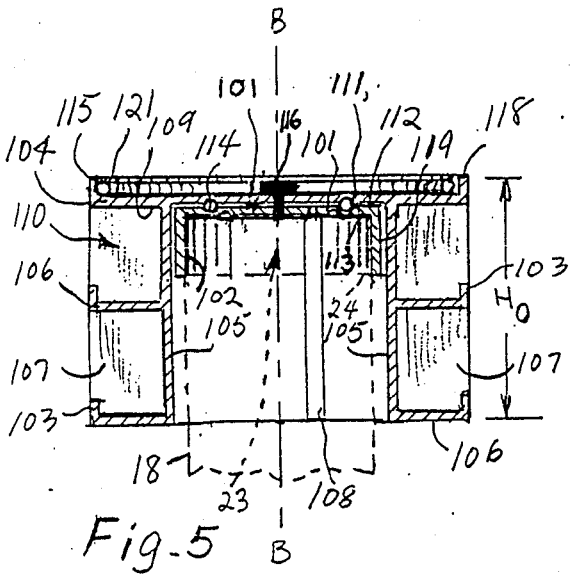
Figure 6:
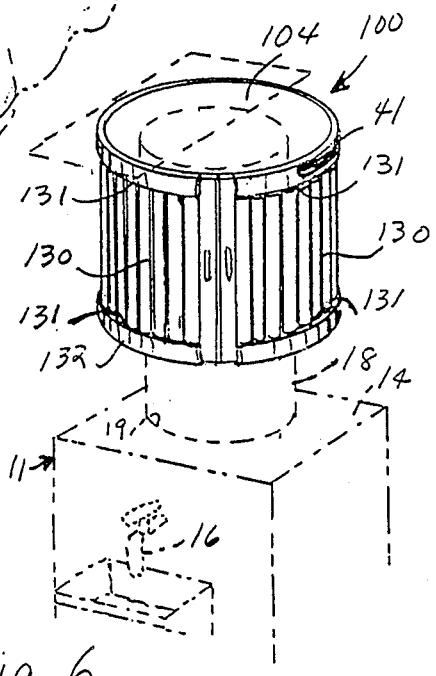

FIGS. 4 and 6 show alternative optional closure means for the carousel embodiment, and FIG. 6 shows a pair of slots 41 and recesses 42 for trays, such as tray 27 or conventional trays (not shown). The left side of FIG. 4 shows in plan view (with annular ring 106 partially broken away); and FIG. 6 shows in perspective, a tambour door assembly 130 sliding in lower and upper tracks 131 which are designed, respectively, in outboard annular extensions 132 of bottom shelf 106 and the underside 109 of top plate 109.

Alternately, as seen in the right side of FIG. 4, a pair of semicircular doors 133, pivoting at the back along hinge 134 may be provided to close the compartments. Or, a plurality of smaller, arcuate doors 135*a, b, c, d*, etc., may be hinged at 136 to provide compartment closures.

It should be understood that various modifications within the of this invention can be made by one of ordinary skill in the art without departing from the spirit thereof. For example, where the water bottle is polygonal in cross-section (i.e. other than the standard 10 ⅝" diameter round), such as a water bottle that is square in cross-section (e.g., a 3 gallon, 8 ¾" wide, square water bottle) the hub means 22,101 and cap 102 may also be square in cross-section rather than round as shown in the figures. As another example, the retaining means (compartmentalized tray 20 or carousel 100) may be made of plastic or ceramic material and the compartments serve as flower or herb pots for indoor plants or a herb garden. We therefore wish our invention to be defined by the scope of the appended claims as broadly as the prior art will permit, and in view of the specification if need be.

We claim:

1. A refreshment center removably supportable on an inverted water bottle of a bottled water dispenser, comprising in operative combination:

(a) means for retaining a plurality of refreshment items, each segregatable by kind from the others in a plurality of individualized compartments, in a related adjacent spatial array;

(b) means for removably mounting said refreshment item compartment means in association with at least an upper substantially planar surface of said water bottle;

(c) said mounting means being attached to said refreshment item compartment means;

(d) said mounting means in combination with said compartment means defining a cap assembly dimensioned to receivingly engage and be removably supported by said water bottle to provide storage for and easy access to refreshment items disposed in said compartments; and (e) said cap assembly extending downwardly from the inverted bottom end of said water bottle along at least a portion of a side wall of said bottle to stably retain said refreshment item compartment means on said water bottle during refreshment item use.

2. A refreshment center as in claim 1 wherein said mounting means includes a substantially planar member disposed to rest on the upper bottom surface of said water bottle.

3. A refreshment center as in claim 2 wherein said planar member is rotatably secured to said retaining means.

4. A refreshment center as in claim 1 wherein said cap assembly includes a generally cylindrical sleeve member extending downwardly along at least a portion of a side wall of said water bottle adjacent the upper inverted bottom end thereof.

5. A refreshment center as in claim 4 wherein said mounting means includes a substantially planar member disposed to rest on the upper bottom surface of said water bottle and to form a cap member in combination with said generally cylindrical sleeve member.

6. A refreshment center as in claim 5 wherein said cap member is rotatably secured to said refreshment item compartment means.

7. A refreshment center as in claim 1 wherein said refreshment item retaining means comprises:

(a) a generally planar bottom member having at least one marginal edge;

(b) at least one upstanding side wall secured adjacent said marginal edge; and (c) means for forming a plurality of individual spaces within the volume defined by said side walls and said bottom member for receiving individual ones of said refreshment items.

8. A refreshment center as in claim 7 wherein said refreshment center includes a base member disposed between said retaining means and said mounting means.

9. A refreshment center as in claim 8 wherein said base member includes means for permitting storage of at least one serving tray in association therewith.

10. A refreshment center as in claim 9 wherein said mounting means includes a generally cylindrical sleeve member extending downwardly along at least a portion of a side wall of said water bottle adjacent the upper inverted bottom end thereof.

11. A refreshment center as in claim 8 wherein said tray storage means includes an entry notch for receiving and retaining said tray.

12. A refreshment center as in claim 7 which includes a bracket member secured to the outside of said side wall for receivingly engaging a serving tray.

13. A refreshment center as in claim 12 wherein said tray includes at least one planar surface having at least one means for retainingly engaging a cup.

14. A refreshment center as in claim 13 wherein said cup engaging means is a hole.

15. A refreshment center as in claim 14 wherein said tray is L-shaped and said bracket member engages a short portion of said L-shaped tray in a first position and a long portion of said L-shaped tray in a second position.

16. A refreshment center as in claim 12 wherein said tray is L-shaped and said bracket member engages a short portion of said L-shaped tray in a first position and a long portion of said L-shaped tray in a second position.

17. A refreshment center as in claim 16 wherein said mounting means includes a generally cylindrical sleeve member extending downwardly along at least a portion of a side wall of said water bottle adjacent the upper inverted bottom end thereof.

18. A refreshment center as in claim 13 wherein said tray is L-shaped and said bracket member engages a short portion of said L-shaped tray in a first position and a long portion of said L-shaped tray in a second position.

19. A refreshment center as in claim 12 wherein said mounting means includes a generally cylindrical sleeve member extending downwardly along at least a portion of a side wall of said water bottle adjacent the upper inverted bottom end thereof.

20. A refreshment center as in claim 12 wherein said mounting means includes a substantially planar member disposed to rest on the upper bottom surface of said water bottle and to form a cap member in combination with said generally cylindrical sleeve member.

21. A refreshment center as in claim 7 wherein said mounting means includes a generally cylindrical sleeve member extending downwardly along at least a portion of a side wall of said water bottle adjacent the upper inverted bottom end thereof.

22. A refreshment center as in claim 21 wherein:

(a) a bracket member is secured to the outside of said side wall for receivingly engaging a serving tray;

(b) said tray includes at least one planar surface having at least one means for retainingly engaging a cup;

(c) said cup engaging means is a hole; and (d) said tray is L-shaped, and said bracket member engages a short portion of said L-shaped tray in a first position and a long portion of said L-shaped tray in a second position.

23. A refreshment center as in claim 22 having four side walls forming a generally rectangular box.

24. A refreshment center as in claim 23 wherein said mounting means includes a substantially planar member disposed to rest on the upper bottom surface of said water bottle and to form a cap member in combination with said generally cylindrical sleeve member.

25. A refreshment center as in claim 24 wherein:

(a) a lid covering a plurality of said refreshment item compartment is provided to prevent loss during transport and use; and (b) said lid is generally planar, oriented horizontally when closed, and hinged to provide a closed serving position permitting serving from an outside top surface thereof and an open access position.

26. A refreshment center as in claim 7 which includes an auxiliary utensil box attached to the outside of said side wall.

27. A refreshment center as in claim 7 which includes a lid covering a plurality of said refreshment item spaces to prevent loss during transport and use.

28. A refreshment center as in claim 27 wherein said lid is generally planar, oriented horizontally when closed, and hinged to provide a closed serving position permitting serving from an outside top surface thereof and an open access position.

29. A refreshment center as in claim 7 having four side walls forming a generally rectangular box.

30. A refreshment center as in claim 1 wherein said refreshment item compartment means comprises a plurality of tiers of said refreshment item compartment disposed outwardly from and along at least a portion of the side wall of said water bottle.

31. A refreshment center as in claim 30 wherein said tiers extend above the inverted bottom surface of said water bottle.

32. A refreshment center as in claim 30 wherein:

(a) said refreshment item compartment means includes a first cylinder having an inner diameter greater than the outer diameter of said water bottle;

(b) said mounting means includes a plate disposed adjacent one end of said cylinder; and (c) said refreshment center is mounted on said water bottle with said water bottle received in said cylinder, and said plate resting on the inverted bottom end thereof.

33. A refreshment center as in claim 32 wherein:

(a) said refreshment item compartment means includes a planar horizontal member extending laterally beyond the outer diameter of said water bottle to form a serving surface, said horizontal planar member being disposed above said plate;

(b) said planar member and said plate being rotatably secured to each other permitting rotation of said refreshment center about said water bottle in carousel fashion.

34. A refreshment center as in claim 33 wherein said planar member is spaced sufficiently above said plate to provide a volume there between for storage of large objects above the inverted bottom surface of said water bottle.

35. A refreshment center as in claim 33 wherein said horizontal member includes at least a marginal edge and an upstanding lip disposed partially around and adjacent said marginal edge to form a cutting and serving surface.

36. A refreshment center as in claim 32 which includes a second inner cylinder of diameter greater than the outer diameter of said water bottle and less than said first cylinder, and said second cylinder is secured to one end of said plate to form a cap.

37. A refreshment center as in claim 36 wherein:

(a) said refreshment item compartment means includes a planar horizontal member extending laterally beyond the outer diameter of said water bottle to form a serving surface, said horizontal planar member being disposed spaced above said plate;

(b) said planar member and said plate being rotatably secured to each other permitting rotation of said refreshment center about said water bottle in carousel fashion.

38. A refreshment center as in claim 30 wherein said tiers of refreshment item spaces have closure means to prevent spillage of contents during transport and use.

39. A refreshment center as in claim 38 wherein said closure means are independently openable on a plurality of said individual refreshment item spaces.

40. A refreshment center as in claim 38 wherein said closure means are tambour doors.

41. A refreshment center removably supportable on an inverted water bottle of a bottled water dispenser, comprising in operative combination:

(a) means for retaining a plurality of refreshment items, each segregatable by kind from the others in a plurality of individualized compartments, in a related adjacent spatial array;

(b) means for removably mounting said refreshment item compartment means in association with at least an upper substantially planar surface of said water bottle;

(c) said mounting means being attached to said refreshment item compartment means;

(d) said mounting means in combination with said compartment means defining a cap assembly dimensioned to receivingly engage and be removably supported by said water bottle to provide storage for and easy access to refreshment items disposed in said compartments;

(e) said cap assembly extending downwardly from the bottom of said inverted water bottle along at least a portion of a side wall of said bottle to stably retain said refreshment item compartment means on said water bottle during refreshment item use;

(f) said refreshment item compartment means comprises a plurality of tiers of said refreshment item compartments disposed outwardly from and along at least a portion of the side wall of said water bottle;

(g) said refreshment item compartment means includes a first cylinder having an inner diameter greater than the outer diameter of said water bottle;

(h) said mounting means includes a plate disposed adjacent one end of said cylinder;

(i) said refreshment center is mounted on said water bottle with said water bottle received in said cylinder, and said plate resting on the inverted bottom end thereof; and (j) a vertical view slot provided in said portion of said refreshment center disposed adjacent to said side wall of said water bottle to permit a user to monitor the water level in said water bottle.

42. A refreshment center as in claim 41 which includes:

(a) a second inner cylinder of a diameter greater than the outer diameter of said water bottle and less than said first cylinder, and said second cylinder is secured to one end of said plate to form a cap; and wherein:

(b) said vertical view slot is provided in at least a portion of said second inner cylinder disposed adjacent to side wall of said water bottle to permit a user to monitor the water level in said water bottle.

43. A refreshment center removably supportable on an inverted water bottle of a bottled water dispenser, comprising in operative combination:

(a) means for retaining a plurality of refreshment items, each segregatable by kind from the others in a plurality of individualized compartments, in a related adjacent spatial array;

(b) means for removably mounting said refreshment item compartment means in associated with at least an upper substantially planar surface of said water bottle;

(c) said mounting means being attached to said refreshment item compartment means;

(d) said mounting means in combination with said compartment means defining a cap assembly dimensioned to receivingly engage and be removably supported by said water bottle to provide storage for and easy access to refreshment items disposed in said compartments;

(e) said cap assembly extending downwardly from the bottom of said inverted water bottle along at least a portion of a side wall of said bottle to stably retain said refreshment item compartment means on said water bottle during refreshment item use;

(f) said cap assembly includes a generally cylindrical sleeve member extending downwardly along at least a portion of a side wall of said water bottle adjacent the upper inverted bottom end thereof; and (g) a vertical view slot provided in at least a portion of said cylindrical sleeve disposed adjacent to side wall of said water bottle to permit a user to monitor the water level in said water bottle.

* * * * *